US007913532B2

(12) United States Patent
Battheu et al.

(10) Patent No.: US 7,913,532 B2
(45) Date of Patent: Mar. 29, 2011

(54) MANIPULATOR FOR METAL SHEETS

(75) Inventors: Claude Battheu, Schio (IT); Gianfranco Venturini, Cologna Veneta (IT)

(73) Assignee: Salvagnini Italia S.p.A., Sarego (IT)

( * ) Notice: Subject to any disclaimer, the term of this patent is extended or adjusted under 35 U.S.C. 154(b) by 0 days.

(21) Appl. No.: 11/939,988

(22) Filed: Nov. 14, 2007

(65) Prior Publication Data

US 2008/0121010 A1 May 29, 2008

(30) Foreign Application Priority Data

Nov. 23, 2006 (IT) ..... MI2006A2240

(51) Int. Cl.
*B21J 13/10* (2006.01)

(52) U.S. Cl. ..... 72/420; 72/421; 72/426

(58) Field of Classification Search ..... 72/361, 72/405.01, 405.09, 405.11, 405.12, 405.13, 72/420, 421, 422, 418, 419, 417, 423, 425, 72/426, 428, 449; 414/749.1, 751.1; 198/465.1, 198/465.2; 269/61, 71, 73
See application file for complete search history.

(56) References Cited

U.S. PATENT DOCUMENTS

| | | | | |
|---|---|---|---|---|
| 3,259,929 | A * | 7/1966 | De Meerendonk Gerardus | 470/89 |
| 3,358,490 | A * | 12/1967 | Heine, Jr. | 72/209 |
| 4,023,788 | A | 5/1977 | Herb et al. | |
| 4,068,519 | A * | 1/1978 | Baringer | 72/426 |
| 4,274,801 | A | 6/1981 | Herb et al. | |
| 4,373,648 | A * | 2/1983 | Wright et al. | 223/28 |
| 4,516,663 | A * | 5/1985 | D'Alessio et al. | 187/270 |
| 4,583,719 | A | 4/1986 | Klingel | |
| 4,600,358 | A * | 7/1986 | Graf | 414/751.1 |
| 4,621,516 | A * | 11/1986 | Schafer et al. | 72/405.12 |
| 4,658,626 | A * | 4/1987 | Yamada et al. | 72/405.1 |
| 4,879,894 | A * | 11/1989 | Benedict et al. | 72/405.12 |
| 5,551,552 | A * | 9/1996 | Ophardt et al. | 198/465.1 |
| 5,701,791 | A | 12/1997 | Schulze et al. | |
| 5,881,601 | A * | 3/1999 | Hammer | 74/422 |
| 6,796,198 | B2 * | 9/2004 | Broetto | 74/89.17 |
| 7,040,133 | B2 * | 5/2006 | Hu | 72/149 |
| 7,210,328 | B2 * | 5/2007 | Strasser | 72/420 |

FOREIGN PATENT DOCUMENTS

EP 1447156 A1 8/2004

* cited by examiner

*Primary Examiner* — Edward Tolan
(74) *Attorney, Agent, or Firm* — Novak Druce + Quigg LLP; Gregory A. Nelson

(57) ABSTRACT

A manipulator of a metal sheet (4) is disclosed, comprising pickup means (8) for picking up the metal sheet, which pickup means (8) is connected to a rack (3) associable with a first pinion (1) and an operating head (9). The manipulator comprises at least a second pinion (2) and the first (1) and the second (2) pinions are arranged along the movement path of the metal sheet (4); at least one between the first (1) and the second (2) pinions are each time engaged with said rack (3) to move the rack from one part to the other of the operating head (9) (FIG. 2).

4 Claims, 3 Drawing Sheets

MANIPULATOR FOR METAL SHEETS

The present invention relates to a manipulator for metal sheets.

Manipulators for metal sheets are generally known comprising an operating head for machining the sheets, pickup means for picking up the sheets and means for shifting the metal sheets and supplying the metal sheets to the operating head.

Traditional manipulators comprise a sole pinion and a rack to which the pickup means for the metal sheet are attached. The pinion-rack apparatus comprises a rack of a certain length and a driven pinion for moving the rack; pickup means for a metal sheet are associated with the rack.

In view of the prior art, the object of the present invention is to provide a manipulator for metal sheets that is more efficient than known manipulators, and in particular permits a longer rack stroke for the same length of rack or the use of a shorter and therefore stiffer and less heavy rack for the same stroke.

According to the present invention, said object is achieved by means of a manipulator for a metal sheet comprising pickup means for picking up said metal sheet connected to a rack associable with a first pinion and an operating head, characterised in that it comprises at least one second pinion, said first and second pinion being arranged along the movement path of the metal sheet and at least one of said first and second pinions being engaged each time with said rack to move the rack from one part to the other of the operating head.

The features and advantages of the present invention will be clearer from the following description of an embodiment thereof illustrated by way of non-limiting example in the attached drawings, in which.

Figure 1:
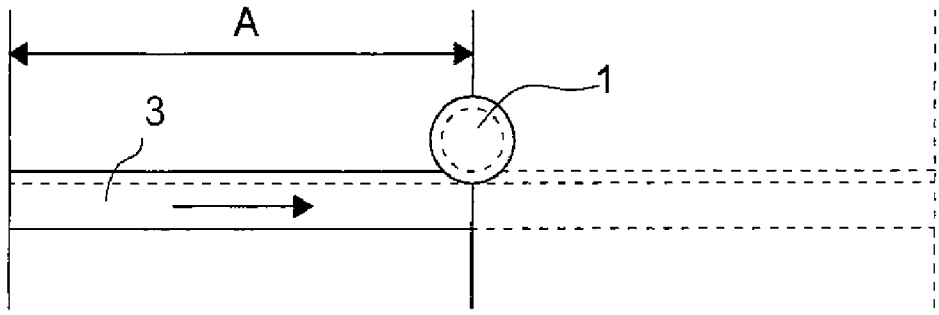
FIG. 1 is a diagram of an apparatus with pinion and rack of a known manipulator.

With reference to FIG. 1 there is shown schematically an apparatus according to the prior arts comprising a sole pinion 1 with a rack 3 of a length A that is able to perform strokes of the same length.

Figure 2:
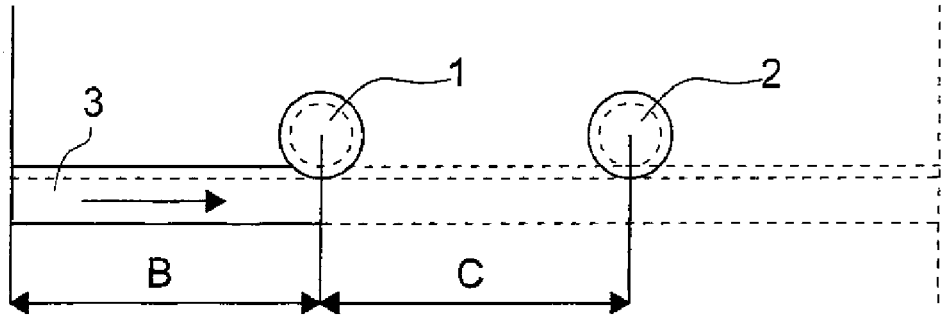
FIG. 2 is a diagram of an apparatus with pinions and rack of a manipulator according to the present invention.

With reference to FIG. 2 there is shown schematically a pinion-rack apparatus of a manipulator according to the present invention. The apparatus comprises a first pinion 1 and a second pinion 2 that are placed at a mutual distance C and are engageable with a rack 3 that has a length B that is less than the length A of the rack in FIG. 1. In a first work step the rack 3 is moved by the pinion 1, in a subsequent step it is moved by both pinions 1 and 2 and in the final step by pinion 2 only.

Figure 5:
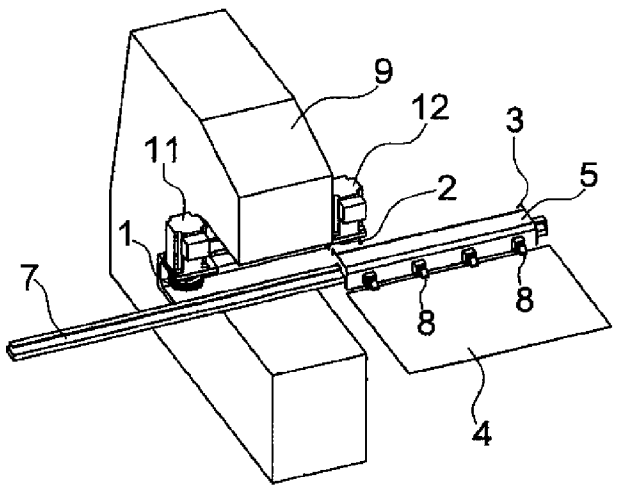
FIGS. 3-5 are diagrams of a manipulator according to the present invention during the steps of moving the metal sheet.
Figure 4:
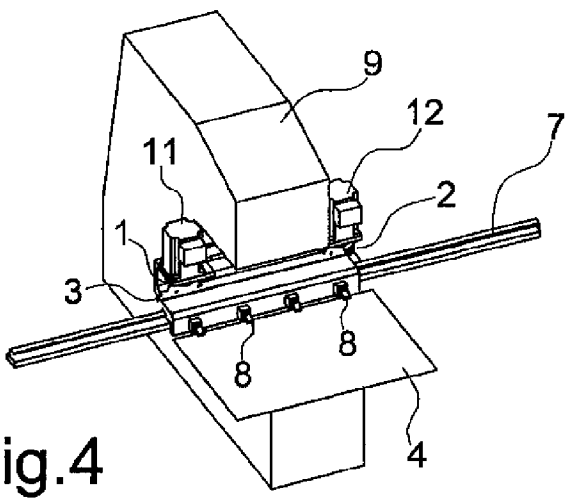
Figure 3:
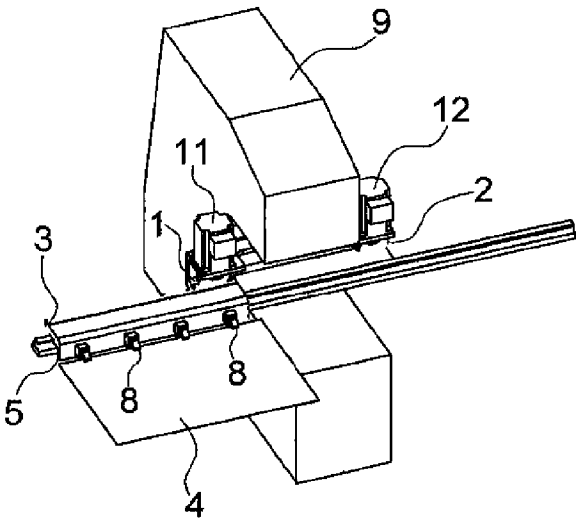

In FIGS. 3-5 there is shown a manipulator according to the present invention in the steps of moving a metal sheet 4; the manipulator comprises the pinion-rack apparatus in FIG. 2.

Figure 6:
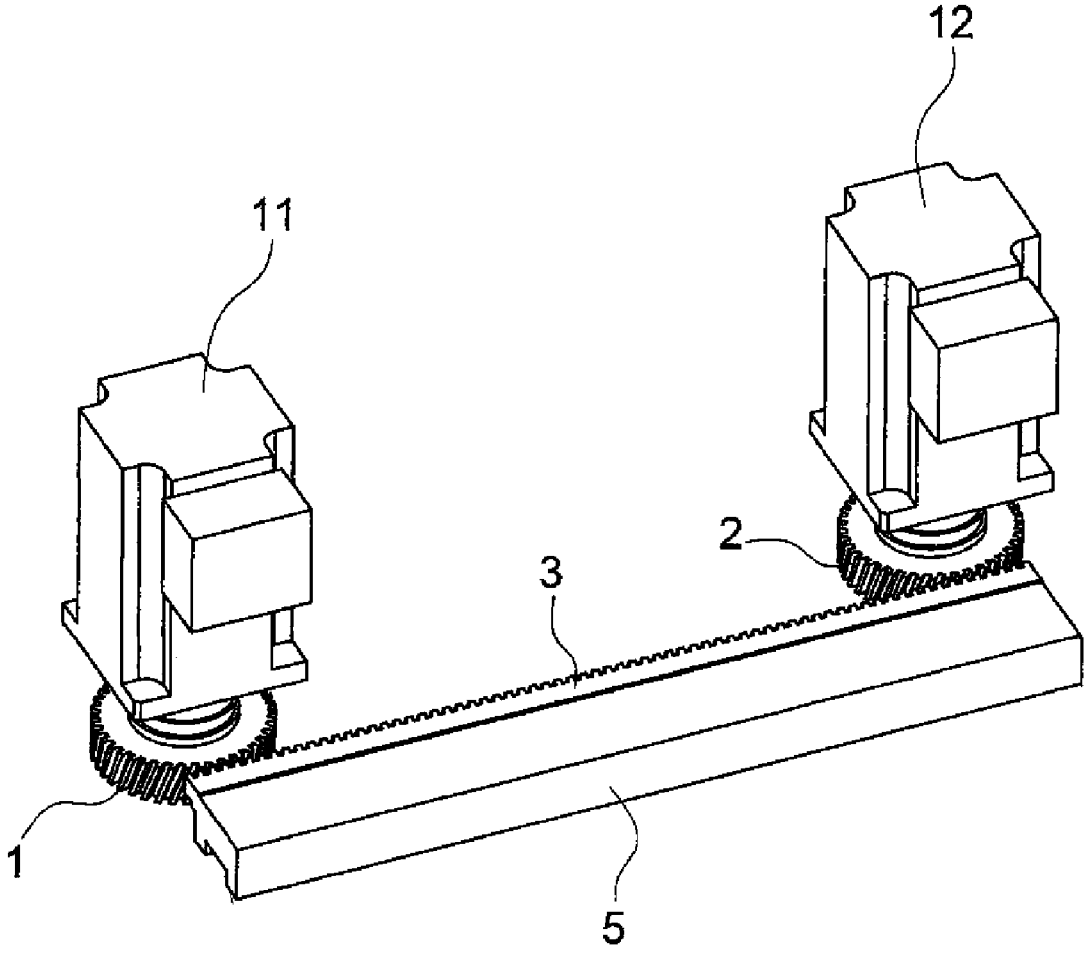
FIG. 6 is a diagram of a part of the pinion-rack apparatus of the manipulator in FIG. 4.

A bar 5 that is slidable in a horizontal direction on a guide 7 that is integral with the manipulator comprises grippers 8 for picking up the metal sheet 4 and the rack 3. The pinions 1 and 2 are preferably interrupted by an operating head 9 in the movement path of the metal sheet 4 and in such a manner that at least one of the pinions is engaged with the rack 3; the pinions are preferably arranged symmetrically with respect to the operating head 9. The pinions 1 and 2 are driven by suitable electric motors 11 and 12 as more clearly visible in FIG. 6.

In a first step (FIG. 3) of supplying the metal sheet 4 the rack 3 is moved by pinion 1 only to obtain a horizontal shift of the metal sheet 4 to the operating head 9.

In a second step (FIG. 4) of machining the metal sheet 4 the rack 3 is moved by both pinions 1 and 2 with the metal sheet placed below the operating head 9.

In a third step of ejecting the metal sheet 4 (FIG. 5), the rack 3 is moved by pinion 2 only to obtain a horizontal shift of the metal sheet 4 away from the operating head 9.

With said manipulator it is possible to decrease the length and the weight of the rack 3 whilst maintaining the same stroke or, whilst maintaining the same length, stiffness and weight of the rack, it is possible to increase the stroke of the rack if suitable torque is available.

It is clear that although the embodiment shown in the drawings includes two pinions 1 and 2, the number of pinions can also be higher without falling outside the protective scope of the claimed invention. In substance, the number of pinions may vary from 2 to n.

We claim:

1. A combination of a manipulator for a metal sheet (4) and an operating head (9), said manipulator comprising pickup means (8) for picking up said metal sheet, which pickup means (8) is connected to a rigid rack (3) associable with a first pinion (1) and said operating head (9), characterised in that it comprises at least one second pinion (2), said first (1) and second (2) pinions being arranged along the movement path of the metal sheet (4), said operating head (9) being arranged between the first (1) and second (2) pinions, said first (1) and second (2) pinions arranged to transfer movement to said rigid rack (3), and said rigid rack (3) arranged to engage with said first pinion (1), said second pinion (2), and both said first (1) and second (2) pinions as the rigid rack moves from one part of the operating head to another part of the operating head (9), said first (1) and second (2) pinions being individually controlled.

2. A combination of a manipulator for a metal sheet and an operating head according to claim 1, characterised in that said first (1) and second (2) pinions are interrupted by the operating head (9) in the movement path of the metal sheet (4).

3. A combination of a manipulator for a metal sheet and an operating head according to claim 2, characterised in that said first (1) and second (2) pinions are arranged in a symmetrical manner with respect to the operating head (9) in the movement path of the metal sheet (4).

4. A combination of a manipulator for a metal sheet and an operating head according to claim 1, characterised in that said operating head (9) is adapted to machine the metal sheet (4).

* * * * *